US009868451B2

(12) United States Patent
Aaron et al.

(10) Patent No.: US 9,868,451 B2
(45) Date of Patent: Jan. 16, 2018

(54) SELF-UNLOADING AGGREGATE TRAIN

(71) Applicant: Georgetown Rail Equipment Company, Georgetown, TX (US)

(72) Inventors: Charles Wayne Aaron, Georgetown, TX (US); Edwin deSteiguer Snead, Georgetown, TX (US)

(73) Assignee: GEORGETOWN RAIL EQUIPMENT COMPANY, Georgetown, TX (US)

( * ) Notice: Subject to any disclaimer, the term of this patent is extended or adjusted under 35 U.S.C. 154(b) by 191 days.

(21) Appl. No.: 14/199,080

(22) Filed: Mar. 6, 2014

(65) Prior Publication Data

US 2014/0271071 A1 Sep. 18, 2014

Related U.S. Application Data

(60) Provisional application No. 61/790,653, filed on Mar. 15, 2013.

(51) Int. Cl.

| | |
|---|---|
| ***B61D 7/32*** | (2006.01) |
| ***B61D 7/00*** | (2006.01) |
| ***E01B 27/00*** | (2006.01) |

(52) U.S. Cl.

CPC ..... *B61D 7/00* (2013.01); *B61D 7/32* (2013.01); *E01B 27/00* (2013.01)

(58) Field of Classification Search

CPC . B61D 7/00; B61D 7/32; B61D 15/00; B65G 67/24; E01B 2203/032; E01B 27/00; E01B 2203/036; E01B 27/02

See application file for complete search history.

(56) References Cited

U.S. PATENT DOCUMENTS 3,167,193 A * 1/1965 Klosk ..... B61D 15/00 414/339

3,430,751 A † 3/1969 Bateson (Continued)

FOREIGN PATENT DOCUMENTS

DE 10338463 A1 † 3/2005
EP 0368046 † 3/1993

(Continued)

OTHER PUBLICATIONS

International Searching Authority; International Search Report and Written Opinion issued in PCT/US2015/017807; dated Jun. 3, 2015.

(Continued)

*Primary Examiner* — Mark C Hageman

(74) *Attorney, Agent, or Firm* — Parsons Behle & Latimer

(57) ABSTRACT

A self-unloading aggregate train including a plurality of hopper cars and an individual conveyor belt located beneath each hopper car. The head pulley at one end of each individual conveyor belt may rotate the belt in a direction from a tail pulley towards the head pulley. The head pulley of one hopper car is positioned above and adjacent of a tail pulley of the adjacent hopper car. This arrangement of hopper cars with individual conveyor belts may be used to unload material from the train. The individual conveyor belts may be adapted so that the trajectory of material transfer to an adjacent belt is near the pivot point between the adjacent hopper cars. The individual conveyor belts may have a substantially constant slope. The hopper of the hopper cars may also be configured with a substantially constant slope that matches the slope of the individual conveyor belts.

29 Claims, 4 Drawing Sheets

(56) References Cited

U.S. PATENT DOCUMENTS 3,842,994 A * 10/1974 Theurer ..... B61D 7/32 198/352
4,576,538 A * 3/1986 Theurer ..... B61D 15/00 104/2
4,795,264 A * 1/1989 Riker ..... B28C 9/0472 198/543
4,795,301 A * 1/1989 Snead ..... E01B 27/04 414/339
4,909,699 A * 3/1990 Tandy ..... B61D 7/32 198/586
4,923,355 A † 5/1990 Mancini
4,925,356 A * 5/1990 Snead ..... E01B 27/02 414/339
5,131,798 A * 7/1992 Bell ..... E01B 27/00 105/269
5,151,002 A † 9/1992 Theurer
5,289,648 A † 3/1994 Theurer
5,341,746 A * 8/1994 Theurer ..... E01B 27/00 104/2
5,364,221 A * 11/1994 Theurer ..... B61D 3/16 104/2
5,423,268 A * 6/1995 Bounds ..... B61D 7/24 104/2
5,944,469 A * 8/1999 Theurer ..... B61D 15/00 213/62 R
7,644,778 B2 * 1/2010 Rossanigo ..... E01B 27/00 171/16
2005/0281643 A1 * 12/2005 Villar ..... B61D 15/00 414/339

FOREIGN PATENT DOCUMENTS

FR 8113290 † 1/1983
JP 2007205088 † 8/2007

OTHER PUBLICATIONS

Canadian Intellectual Property Office; Office Action for Canadian Patent Application No. 2,931,832, dated Feb. 6, 2017.
Superior Pulley & Take-Up Catalog © Mar. 2010, Superior Industries, LLC. C-107, pp. cover, A-34, back.†

* cited by examiner
† cited by third party

SELF-UNLOADING AGGREGATE TRAIN

RELATED APPLICATION

The present application claims the benefit of U.S. Provisional Patent Application Ser. No. 61/790,653, filed on Mar. 15, 2013 and entitled SELF-UNLOADING AGGREGATE TRAIN, the disclosure of which is incorporated herein by reference in its entirety.

FIELD OF THE DISCLOSURE

The present application generally relates to a self-unloading aggregate train. The self-unloading aggregate train may be adapted to permit unloading on a curved portion of railroad track.

BACKGROUND

Description of the Related Art

It is known to use an endless conveyor belt to traverse the length of a train comprising a plurality of hopper cars to unload material, such as aggregate, from the hopper cars positioned along the train. An elongated transfer conveyor, or boom, may be positioned at the end of the train on a trailer car to unload the material to a desired location adjacent to the railroad track on which the train is positioned. The use of an endless conveyor belt may limit the areas along a railroad track at which the material may be unloaded from the train. For example, running the endless conveyor belt while a portion of the hopper cars of the train are positioned along a curved portion of the railroad may be problematic.

An endless conveyor belt system is disclosed in U.S. Pat. No. 4,925,356 entitled Self-Unloading Train for Bulk Commodities, which is incorporated by reference herein. A continuous belt may be "trained" to navigate a minimal curve. However, even in a minimal curve the continuous belt could slip or become "untrained" potentially damaging parts of the system or the belt. U.S. Pat. No. 5,119,738 entitled Hopper Construction is also incorporated by reference herein.

The present disclosure is directed to addressing one or more of the above issues.

SUMMARY

It would be beneficial to provide a conveyor belt system that permits the unloading of material while a portion of a train is positioned on a curved section of railroad.

One embodiment is a system of a self-unloading train that includes a plurality of hopper cars, each hopper car including an individual conveyor belt.

One embodiment is a self-unloading train comprising a plurality of hopper cars. Each hopper car includes an individual conveyor belt positioned beneath a portion of the hopper. Each individual conveyor belt includes a rearward end and a forward end, wherein each rearward end is positioned at least slightly higher than the forward end of the adjacent conveyor belt. Each hopper car may include a mechanism to apply tension to a portion of the individual conveyor belt to prevent conveyor belt slip. Each hopper car may include a guide positioned above the individual conveyor belt adapter to prevent material from falling off the individual conveyor belt. The rearward ends of the individual conveyor belts may be adapted to transfer material to the individual conveyor belt of an adjacent hopper car near the pivot point with the adjacent hopper car.

One embodiment is a method of moving material to a rear of a train. The method comprises dropping material to a first conveyor belt and rotating the first conveyor belt to move material towards the rear of the train. The method further comprises elevating a rearward portion of the first conveyor belt, and transferring material to a second conveyor belt positioned towards the rear of the train with respect to the first conveyor belt.

These and other embodiments of the present disclosure will be discussed more fully in the description. The features, functions, and advantages can be achieved independently in various embodiments of the claimed invention, or can be combined in yet other embodiments One embodiment is a self-unloading train comprising a plurality of hopper cars, wherein each hopper car includes a hopper and an individual conveyor belt positioned beneath at least a portion of the hopper and wherein each individual conveyor belt includes a first end and a second end, the first end having a lower height than a height of the second end. The second end of the individual conveyor belt of one of the plurality of hopper cars may be positioned higher than and adjacent a first end of a conveyor belt on a stacker car and the second end of the individual conveyor belts of the rest of the plurality of hopper cars may be positioned higher than and adjacent the first end of the individual conveyor belt of an adjacent hopper car of the plurality of hopper cars.

Each individual conveyor belt may have a substantially constant slope from the first end to the second end. As used herein, the term "slope" shall mean any configuration of a conveyor belt that has a non-zero (i.e. horizontal) slope. Each of the hopper cars may include a plurality of gates that open and close an opening in the hopper. The bottom of each hopper may have a slope that is substantially the same as the slope of the individual conveyor belt. Each hopper car may include a guide positioned above the individual conveyor belt to limit material from falling off the individual conveyor belt. The second ends of the individual conveyor belts may be adapted to transfer material to the first end of the individual conveyor belt of an adjacent hopper car near a pivot point between the adjacent hopper cars.

One embodiment is a method of unloading material from a train comprising depositing material to a first conveyor belt, rotating the first conveyor belt to move material towards a second end of the first conveyor belt, and transferring the material to a first end of a second conveyor belt positioned below and adjacent to the second end of the first conveyor belt. The second end of the first conveyor belt is elevated with respect to a first end of the first conveyor belt.

The method may include inclining the first conveyor belt at a substantially constant slope from the first end to the second end. Transferring material to the second conveyor belt may comprise transferring the material onto the second conveyor belt at a location along the second conveyor belt that is substantially at a pivot point between the rail car of the first conveyor belt and a rail car of the second conveyor belt. Rotating the first conveyor belt may comprise rotating the belt between approximately six (6) feet per second and ten (10) feet per second. The method may include rotating the second conveyor belt to move material towards a second end of the second conveyor belt and transferring the material to a first end of a third conveyor belt positioned below and adjacent to the second end of the second conveyor belt. The second end of the second conveyor belt is elevated with respect to a first end of the second conveyor belt. Transferring the material to the third conveyor belt may comprise transferring the material onto the third conveyor belt at a location along the third conveyor belt that is substantially at a pivot point between the rail car of the second conveyor belt and a rail car of the third conveyor belt.

One embodiment is a system to unload material from a train comprising a first hopper car having a first hopper, a first gate positioned at a bottom of the first hopper, and a first conveyor belt positioned beneath the first gate. The first conveyor belt extends from a first end of the first hopper car to a second end of the first hopper car, wherein the first gate may be actuated to transfer material from the first hopper to the first conveyor belt. The system includes a first tail pulley at the first end of the first hopper car and a first head pulley at the second end of the first hopper car, the first head pulley is positioned at a higher elevation than an elevation of the first tail pulley. The first conveyor belt being positioned around the first tail pulley and the first head pulley with the first tail pulley and first head pulley being configured to rotate the first conveyor belt.

The system to unload material from a train may include a second hopper car connected to the first hopper car, the second hopper car having a second hopper, a second gate positioned at a bottom of the second hopper, and a second conveyor belt positioned beneath the second gate. The second conveyor belt extends from a first end of the second hopper car to a second end of the second hopper car, wherein the second gate may be actuated to transfer material from the second hopper to the second conveyor belt. The system includes a second tail pulley at the first end of the second hopper car and a second head pulley at the second end of the second hopper car, the second head pulley is positioned at a higher elevation than an elevation of the second tail pulley. The second conveyor belt being positioned around the second tail pulley and the second head pulley with the second tail pulley and second head pulley being configured to rotate the second conveyor belt. The second tail pulley may be adjacent and at a lower elevation than the first head pulley.

The positioned of the first head pulley and the rotation of the first conveyor belt may be configured to transfer material to the second conveyor belt at a location on the second conveyor belt substantially at a pivot point between the first hopper car and the second hopper car. The system to unload material from a train may include the first conveyor belt having a predetermined slope from the first tail pulley to the first head pulley. The bottom of the first hopper may be configured with substantially the same predetermined slope from the first end of the first hopper car to the second end of the first hopper car. The second conveyor belt may have the predetermined slope from the second tail pulley to the second head pulley and the bottom of the second hopper may be configured with substantially the same predetermined slope from the first end of the second hopper car to the second end of the second hopper car.

The system to unload material from a train may include a third hopper connected to the second hopper car, the third hopper car having a third hopper, a third gate positioned at a bottom of the third hopper, and a third conveyor belt positioned beneath the third gate. The third conveyor belt extends from a first end of the third hopper car to a second end of the third hopper car, wherein the third gate may be actuated to transfer material from the third hopper to the third conveyor belt. The system includes a third tail pulley at the first end of the third hopper car and a third head pulley at the second end of the third hopper car, the third head pulley is positioned at a higher elevation than an elevation of the third tail pulley. The third conveyor belt being positioned around the third tail pulley and the third head pulley with the third tail pulley and third head pulley being configured to rotate the third conveyor belt. The third tail pulley may be adjacent and at a lower elevation than the second head pulley. The third head pulley may be positioned at a higher elevation and adjacent a first end of a conveyor belt of a stacker car.

One embodiment is a self-unloading train comprising a plurality of hopper cars, wherein each hopper car includes a hopper and at least one gate to control a flow of material from the hopper. The train includes a plurality of conveyor belts, each one of the plurality of conveyor belts is positioned beneath at least one hopper of the plurality of hopper cars, each conveyor belt of the plurality of conveyor belts being configured to receive material from the at least one hopper through the at least one gate. Wherein each conveyor belt of the plurality of conveyor belts includes a first end and a second end, the second end having a higher elevation than an elevation of the first end. Wherein the second end of a first conveyor belt of the plurality of conveyor belts is positioned adjacent a first end of a second conveyor belt of the plurality of conveyor belts so that material will transfer from the first conveyor belt to the second conveyor belt.

Figure 1:
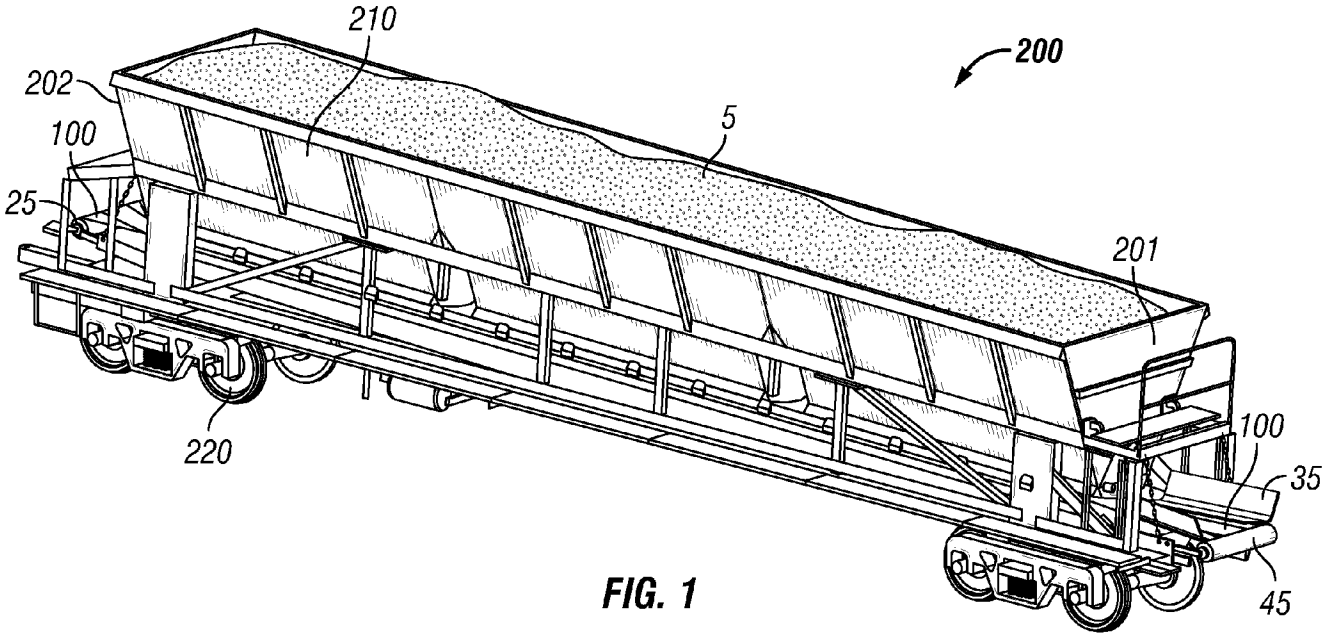
FIG. 1 shows an embodiment of a hopper car that includes an individual conveyor belts used to move material, such as aggregate, along the length of the hopper car.

While the disclosure is susceptible to various modifications and alternative forms, specific configurations have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure as defined by the appended claims.

DETAILED DESCRIPTION

Illustrative embodiments are described below as they might be employed in an apparatus and method for a self-unloading aggregate train. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Further aspects and advantages of the various embodiments will become apparent from consideration of the following description and drawings. These embodiments are described in sufficient detail to enable those skilled in the art to practice the invention, and it is to be understood that modifications to the various disclosed embodiments can be made, and other embodiments can be utilized, without departing from the spirit and scope of the present invention. The following detailed description is, therefore, not to be taken in a limiting sense.

It may be advantageous to be able to have a self-unloading aggregate train which can unload into a window along the side of a railroad track or into one or multiple stock piles. It may also be advantageous if the self-unloading train is adapted to operate in any track conditions, such as in straight or curved track, or while the train is moving into or out of a curve. The conveyor system of the present disclosure is adapted to operate on an aggregate train while the train is positioned on or traveling on any track including traveling on a track with a high degree of curvature.

A self-unloading aggregate train including a plurality of hopper cars may include an individual conveyor belt on each hopper car. The individual conveyor belts should be adapted to properly convey the material, such as aggregate, between conveyor belts as the material transitions along the hopper cars to the end of the train to the unloading car. The individual belts are adapted to prevent the material from spilling or bouncing off the belts as the material transitions between adjacent belts. The individual belts may be adapted so that the trajectory of the material as it leaves a first belt lands on a second belt at or near the center of pivot between the adjacent hopper cars. The system may include guides adapted to deflect material, such as aggregate, back onto the center of a conveyor belt should it be off center and/or bouncing on the belt. The adjacent belts are adapted to ensure the transfer of material between the belts, the conveyor belts and systems should be adapted so that they do not engage or contact rigid portions of the adjacent hopper car as the hopper cars rotate relative to each other as the train travels in or out of curves on the railroad track.

One configuration of the present disclosure is an individual conveyor belt extending from a tail pulley to a head pulley positioned beneath each hopper of a train of hopper cars. The conveyor belt is inclined from the tail pulley to the head pulley and may have a constant slope from the tail pulley to the head pulley. Alternatively, a portion of the conveyor belt may be horizontal with another portion of the conveyor belt sloped so that the head pulley is positioned at a greater height than the tail pulley. Alternatively, a single individual conveyor belt may be adapted to span the hoppers of two or three or more adjacent hopper cars.

FIG. 1 illustrates a hopper car 200 that has a first end 201, a second end 202, and wheels 220 adapted so that the hopper car 200 may travel along railroad tracks. The hopper car 200 includes a hopper 210 that is adapted to hold material 5, which may be aggregate material. Gates 230 (shown in FIGS. 5 and 6) may be actuated to drop material 5 onto a conveyor belt 100 positioned beneath the hopper 210. The conveyor belt 100 extends from the first end 201 to the second end 202 of the hopper car 200. The conveyor belt 100 may be rotated using a head pulley 25 located at the second end 202 of the hopper car 200 and using a tail pulley 45 located at the first end 201 of the hopper car 200.

The conveyor belt 100 is rotated to move material 5 positioned on the belt 100 away from the tail pulley 45 or the first end 201 and towards the head pulley 25 or the second end 202. The head and tail pulleys 25, 45 may be adapted to apply a desired tension within the conveyor belt 100. The head pulley 25 and tail pulley 45 may each include internal gearboxes and motors used to drive the pulleys 25, 45 and rotate the belt 100. Alternative mechanisms may be used to rotate the individual conveyor belt 100 of the hopper car 200 as would be appreciated by one of ordinary skill in the art having the benefit of this disclosure. A generator 265 (shown in FIG. 7) is used to provide electricity to the pulleys 25, 45. Alternatively, a generator(s) may be positioned on the hopper car 100 or on a different hopper cars along a train of hopper cars that provide power to the pulley 25, 45 as would be appreciated by one of ordinary skill in the art having the benefit of this disclosure. Only one of the pulleys 25, 45 may be powered to rotate the conveyor belt 100 or alternatively, both pulleys 25, 45 may be used to start the rotation of the belt 100 and the power to one of the pulleys 25, 45 may be turned off once the conveyor belt 100 is rotating to conserve power. Other methods of rotating belt 100, such as with an engine, may also be used.

The tail pulley 45 is positioned at a lower elevation or height than the head pulley 25 of the conveyor belt 100 on the hopper car 200, which permits the transfer of material 5 from the end of the conveyor belt 100 at the head pulley 25 to the tail pulley end of the conveyor belt on an adjacent hopper car as detailed herein. The hopper car 200 may include guides 35 that are adapted to help retain material within the center of the conveyor belt 100 as material 5 is transferred from the conveyor belt 100 of an adjacent hopper car 200. A train comprised of multiple hopper cars 200 having individual conveyor belts 100 may be used to off load material from the hoppers 210 of the hopper cars 200 as detailed herein. The individual conveyor belt 100 may be at a gradual incline so that the head pulley 25 is positioned at a greater height than the tail pulley 45. The individual conveyor belt 100 may be configured at a constant slope between the tail pulley 45 and the head pulley 25. The hopper 210 may also be configured with the bottom angled to correspond with the slope of the conveyor belt 100 so that there is a substantially constant distance from the hopper 210 to the conveyor belt 100 as shown in FIG. 1. The constant distance between the hopper 210 and conveyor belt 100 may aid in the even transfer of material from the hopper 210 to the moving conveyor belt 100. Alternatively, only a portion of the conveyor belt 100 may be inclined with the rest of the conveyor belt being substantially horizontal.

Figure 2:
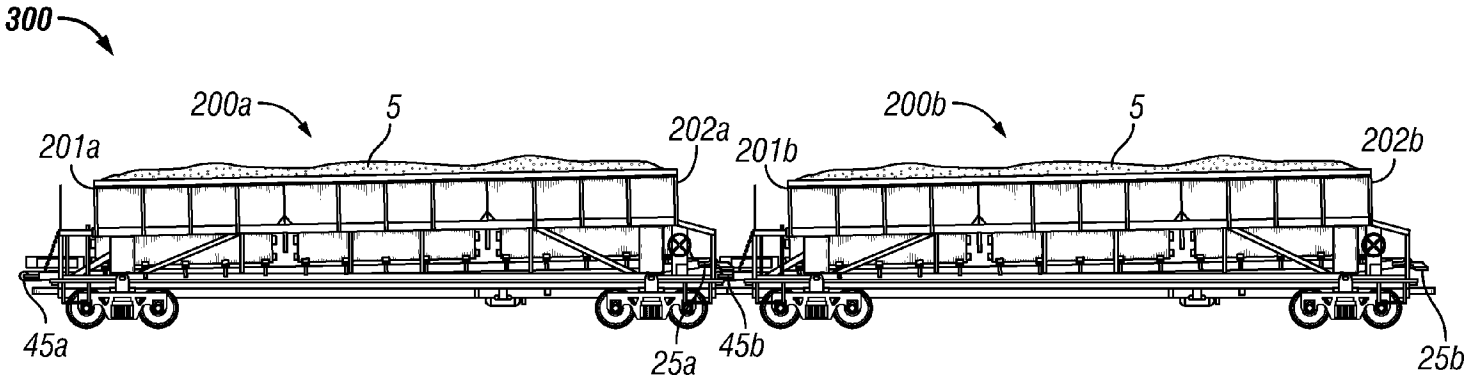
FIG. 2 shows an embodiment of two hopper cars connected together each having an individual conveyor belt positioned below the hopper to transfer material along the length of the hopper car and transfer the material to the individual conveyor belt of the adjacent hopper car.

FIG. 2 shows two hopper cars 200*a*, 200*b* of a self-unloading train 300. Each hopper car 200*a*, 200*b* includes an individual conveyor belt 100 positioned underneath the gates 230 of the hopper 210. The individual conveyor belt 100 of the first hopper car 200*a* may be rotated to move material 5 in a direction from the tail pulley 45*a* or first end 201*a* towards the head pulley 25*a* or second end 202*a*. Likewise, the individual conveyor belt 100 of the second hopper car 200*b* may be rotated to move material 5 in a direction from the tail pulley 45*b* or first end 201*b* to the head pulley 25*b* or second end 200*b*. Material 5 may be conveyed from the end of the conveyor belt 100 at the head pulley 25*a* or second end 202*a* of the first hopper car 200*a* to the end of the conveyor belt 100 at the tail pulley 45*b* or first end 201*b* of the adjacent hopper car 200*b*. In this manner, material 5 may be conveyed along the self-unloading train 300 until it is unloaded off of the train 300 by various mechanisms as a stacker car 260 as is described herein. The stacker car 260 could be positioned on either end of the self-unloading train 300 as the hopper cars 200 may be configured to transfer material to the front or rear of the self-unloading train 300.

Figure 3:
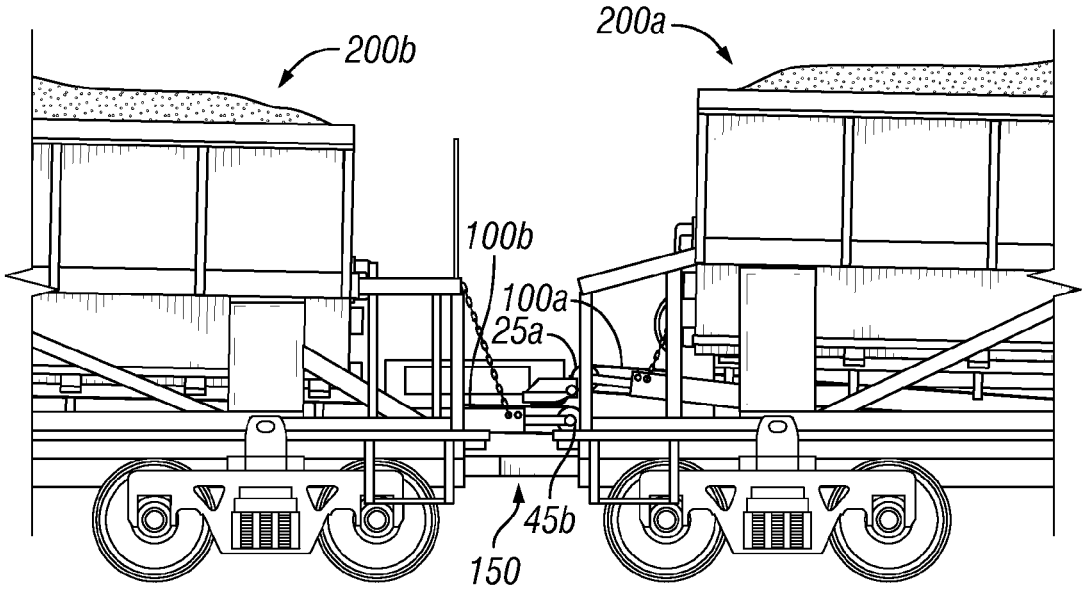
FIG. 3 shows a close-up view embodiment of two hopper cars having individual conveyor belts, the end of one individual conveyor belt is positioned above and adjacent the end of the individual conveyor belt of an adjacent hopper car.

FIG. 3 shows a close-up view of a first hopper car 200*a* connected to a second hopper car 200*b*. Material 5 may be transferred from off the conveyor belt 100*a* of the first hopper car 100*a* at the head pulley 25*a* to a point substantially above the pivot point 150 between the hopper cars 200*a*, 200*b* to the conveyor belt 100*b* of the second hopper car 200*b*. The pivot point 150 is the vertical axis about which two adjacent hopper cars 200 rotate while traversing a curved section of track. The pivot point 150 may be the vertical axis at the mid-point between the two adjacent hopper cars 200 if the two adjacent hopper cars 200 have identical geometries such as car length and truck centers. The conveyor belt 100*b* of the second hopper car 200*b* extends from a tail pulley 45*b* to a head pulley (not shown). The transfer of material 5 from one conveyor belt 100*a* to another conveyor belt 100*b* at substantially the pivot point 150 of two adjacent hopper cars 200*a*, 200*b* permits the transfer of material between hopper cars 200*a*, 200*b* even when the hopper cars 200*a*, 200*b* are traveling through a curved section of railroad track. The tail pulley 45*b* preferably extends beyond the end of hopper car 200*b* so that the conveyor belt 100*b* extends past the pivot point 150 and preferably under head pulley 25*a* to minimize the chance that material 5 during the transfer between belts 100*a*, 100*b* will fall off the end of the conveyor belt 100*b* at the tail pulley 45*b* rather than staying on the belt 100*b* and traveling to the head pulley (not shown) of the conveyor belt 100*b* of the second hopper car 200*b*.

Figure 4A:
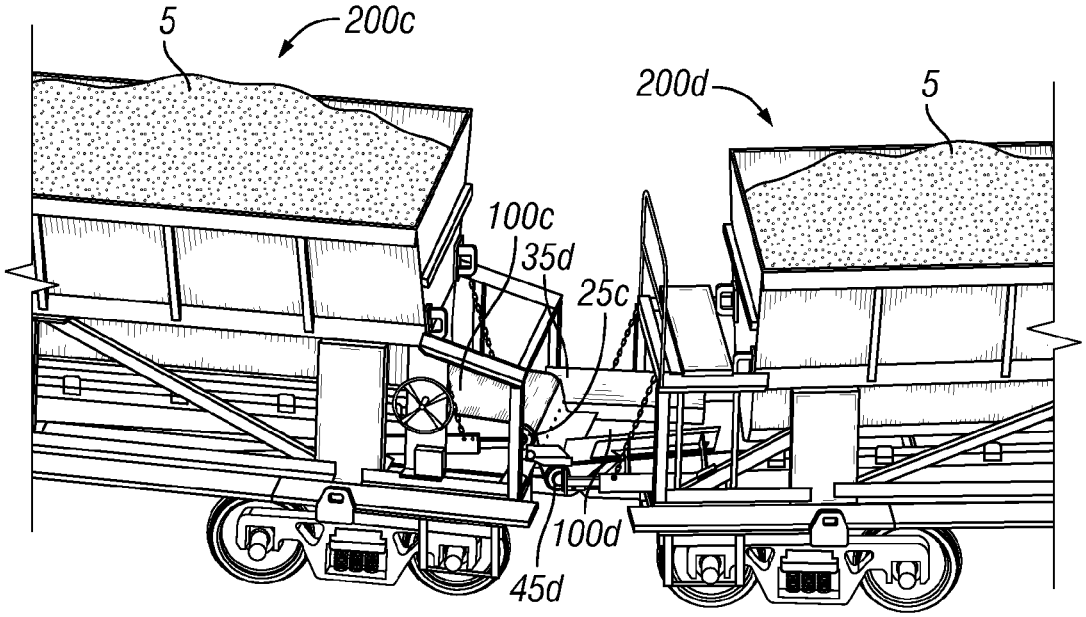
FIG. 4A shows an embodiment of two hopper cars having individual conveyor belts that are position with respect to each other as if the hopper cars are on a curved section of railroad track, the end of one individual conveyor belt is positioned above and adjacent the end of the individual conveyor belt of an adjacent hopper car.

FIG. 4A shows a third hopper car 200*c* connected to a fourth hopper car 200*d* traveling through a curved section railroad track (not shown). The individual conveyor belts 100*c*, 100*d* are configured to permit the transfer of material 5 from the conveyor belt 100*c* at the head pulley 25*c* of the third hopper car 200*c* to the conveyor belt 100*d* of the fourth hopper car 200*d* near the tail pulley 45*d*. The fourth hopper car 200*d* may include guides 35*d* to prevent material 5 from falling off of the conveyor belt 100*d* during the transfer of material 5 between the hopper cars 200*c*, 200*d*. The transfer of material 5 at substantially the pivot point 150 permits the transfer of material 5 between adjacent belts 100 of hopper cars 200 whether the hopper cars 200 are on a straight section of railroad track or traveling through a curved section of track.

The rotation of the individual conveyor belts 100 may be adapted along the train 300 of hopper cars 200 so that the material 5 is transferred appropriately between the individual conveyor belts 100 and conveyed along the length of the train 300. For example, if the rotational speed of the conveyor belts 100 is too slow it may take too long to unload the material 5 from the train 300, and/or the material 5 may fall off the end of the tail pulley 45 as it is transferred depending on the vertical placement of the head and tail pulleys 25, 45. Likewise, if the rotational speed of the conveyor belts 100 is too fast the momentum of the material 5 may cause the material to slide off the sides of the belts 100 if it is being transferred during a curved section of track. The type of material 5 being transferred along the individual conveyor belts 5 may dictate the appropriate speed of the conveyor belts 100 to ensure proper transfer between the belts 100. The rotation speed of the conveyor belts 100 may be optimized to offload the material 5 as quickly as possible while still ensuring the material will land and settle on the adjacent belt 100 at substantially the pivot point 150 when it is transferred between hopper cars 200. The rotational speed of the conveyor belts may be between approximately six (6) feet per second and ten (10) feet per second. Other belt speeds are also possible.

Figure 4B:
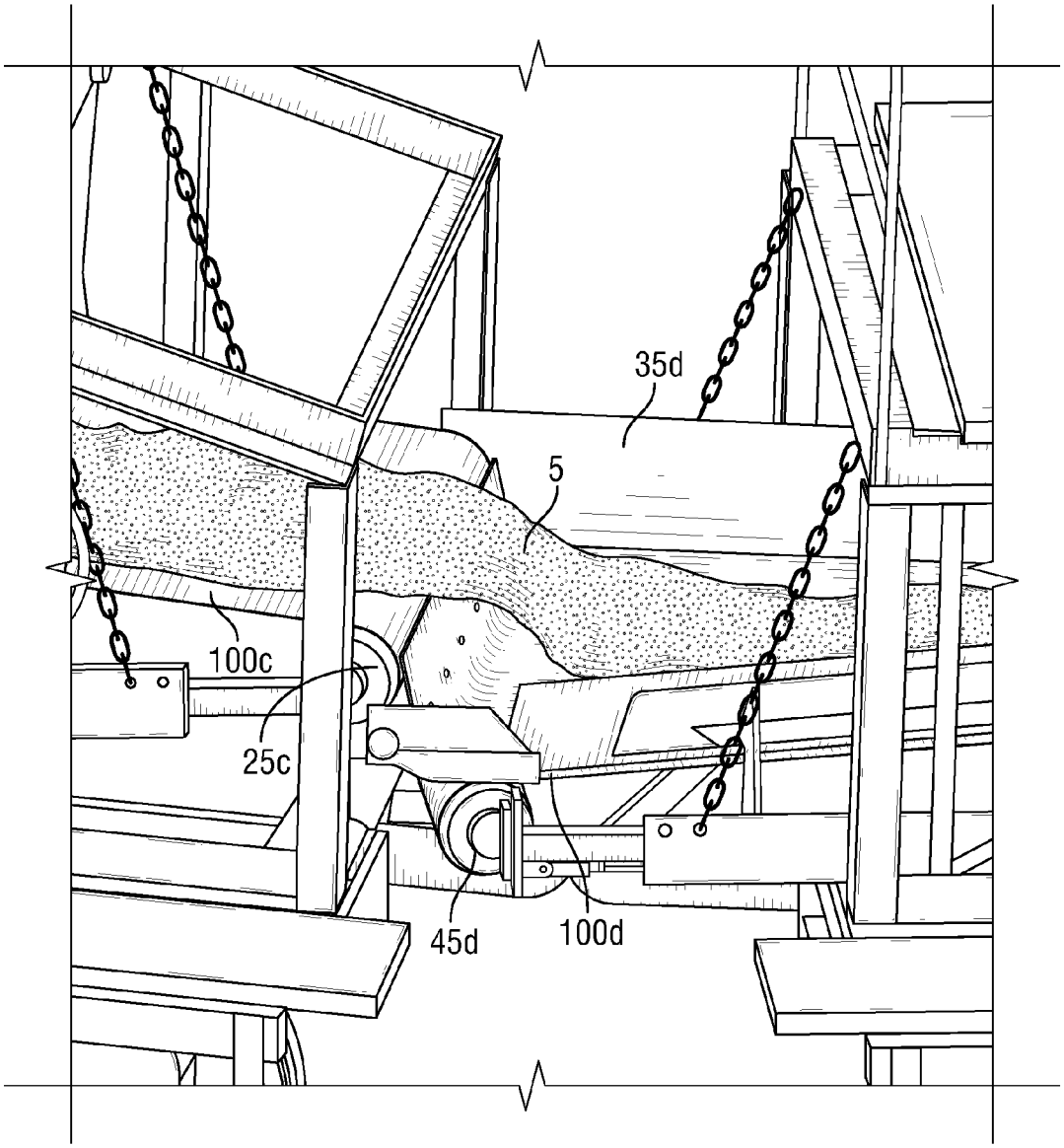
FIG. 4B shows a close-up view of the hopper cars of FIG. 4A with material being transferred from one individual conveyor belt to an adjacent conveyor belt at approximately the pivot point between adjacent hopper cars.

FIG. 4B shows material 5 being transferred from the belt 100*c* of the third hopper car 200*c* to the belt 100*d* of the fourth hopper car 200*d*. The head pulley 25*c* of the third hopper car 200*c* is positioned above and adjacent the tail pulley 45*d* of the fourth hopper car 200*d* such that the material 5 is transfers and settles onto the belt 100*d* of the fourth hopper car 200*d* at substantially the pivot point 150 (shown in FIG. 3) between the two adjacent hopper cars 200*c*, 200*d*. Thus, material 5 may be transferred from an upper belt 100*c* to a lower belt 100*d* between adjacent hopper cars 200*c*, 200*d* even when the hopper cars 200*c*, 200*d* are moving through a curved section of track with the material 5 landing and settling on the lower conveyor belt 100*d*. The configuration of hopper cars 200 with individual belts 100 with the head pulley 25 being elevated higher than the tail pulley 45 permits the transfer of material 5 between the belts 100 along the length of the train 300.

Figure 5:
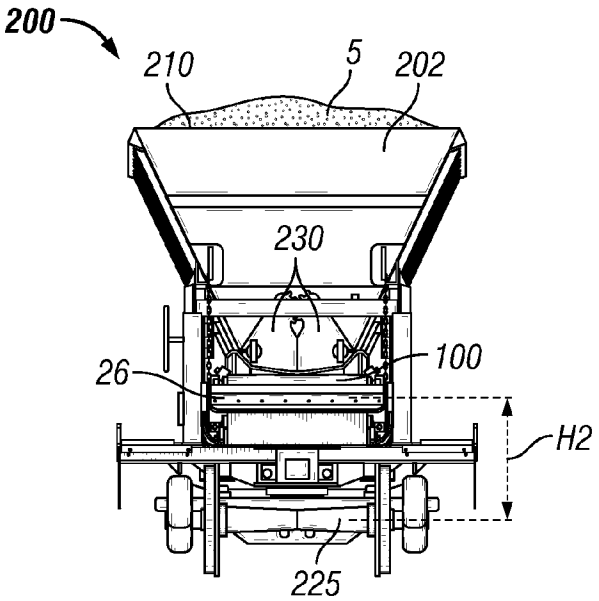
FIG. 5 shows an end view of one embodiment of a hopper car having an individual conveyor belt positioned below the gates on a hopper car.

FIG. 5 shows an end view of the second end 202 of the hopper car 200. Material 5 is positioned within the hopper 210 and may be dropped onto the conveyor belt 100 by actuation of gates 230. The hopper car 200 may include a scraper 26 positioned adjacent the head pulley 25 (not shown in FIG. 5) to ensure material 5 is removed from the conveyor belt 100 as it rotates around the head pulley 25 and travels back to the tail pulley 45 (not shown in FIG. 5). The head pulley 25, which is positioned adjacent to the scraper 26, has a height H2 from the axel 225 of the hopper car 200. The height, or elevation, is measure off of the axel for illustrative purposes only and the height from other references, such as the top of the rail or ground, could be used as would be appreciated by one of ordinary skill in the art having the benefit of this disclosure.

Figure 6:
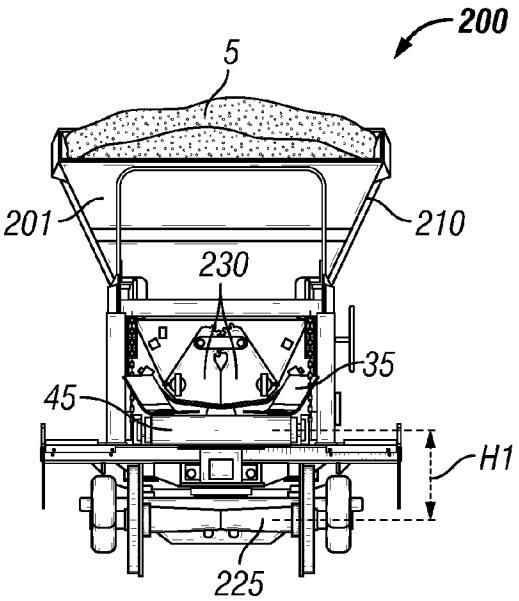
FIG. 6 shows an end view of one embodiment of a hopper car having an individual conveyor belt positioned below the gates on a hopper car.

FIG. 6 shows an end view of the first end 201 of the hopper car 200. Material 5 is positioned within the hopper 210 and may be dropped onto the conveyor belt 100 by actuation of gates 230. The hopper car 200 may include guides 35 positioned adjacent the tail pulley 45 to ensure material 5 remains on the conveyor belt 100 as it is transferred between conveyor belts of adjacent hopper cars 200 of a self-unloading train 300. The tail pulley 45 has a height H1 from the axel 225 of the hopper car 200. The height H1 of the tail pulley 45 is less than the height H2 of the head pulley 25. The self-unloading train 300 will be configured so that the head pulley 25 of a hopper car 200 will be positioned adjacent to a tail pulley 45 of the adjacent car 200. The greater height H2 of each head pulley 25 in comparison to the tail pulleys 45 facilitates the proper transfer of material 5 between the hopper cars 200 of the train 300 and the transfer of material 5 along the length of the train 300 until the material 5 reaches the stacker car 260.

Figure 7:
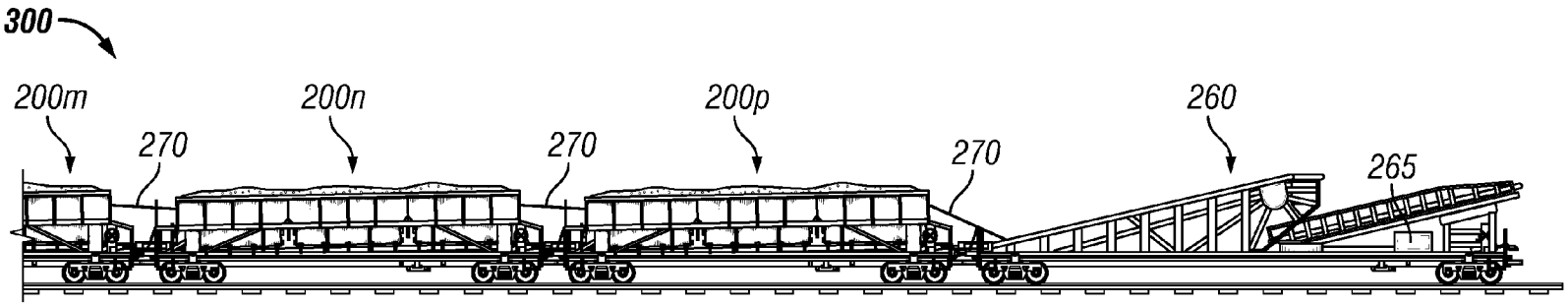
FIG. 7 shows an embodiment of a self-unloading train comprised of hopper cars having individual conveyor belts positioned beneath the hoppers and a stacker car used to unload material off of the train.

FIG. 7 shows a train 300 with hopper cars 200*m*, 200*n*, and 200*p* connected together with a stacker car 260. The stacker car 260 is used to offload the material 5 to a desired location adjacent the railroad track. The stacker car 260 may be one of various embodiments and may include a boom to deposit the material 5 to a desired location as would be appreciated by one of ordinary skill in the art having the benefit of this disclosure. The stacker car 260 may include a generator 265 used to generate power to each of the pulleys 25, 45 along the train 300. The power may be transferred along communication lines 270 that are connected to each of the hopper cars 200 along the train 300. The number of hopper cars 200 shown as part of the train 300 is for illustrative purposes and may be varied depending on the desired application. The location of the communication lines 270 is for illustrative purpose only to indicate their presence within the train 300. The communication lines 270 may also be used to communicate the status of the individual conveyor belts 100 along the train 300. For instance, if the individual conveyor belt 100 of a hopper car 200 shuts down or becomes disabled this event may be detected by cars upstream causing the conveyor belts 100 to temporarily shut down so material does not get transferred to the disabled or stopped belt 100. The communication lines 270 may also be used to uniformly change the rotational speed of the belts 100 along the train 300 or the rotation speed of the belts 100 along a portion of the train 300.

Although this invention has been described in terms of certain preferred embodiments, other embodiments that are apparent to those of ordinary skill in the art, including embodiments that do not provide all of the features and advantages set forth herein, are also within the scope of this invention. Accordingly, the scope of the present invention is defined only by reference to the appended claims and equivalents thereof.

TABLE OF REFERENCE NUMERALS FOR FIGS. 1-7

| |
|---|
| H1—height of tail pulley from axel |
| H2—height of head pulley from axel |
| 5—material |
| 25—head pulley |
| 26—belt scraper |
| 35—guides |
| 45—tail pulley |
| 100—individual conveyor belt |
| 150—pivot point between adjacent hopper cars |
| 200—hopper car |
| 201—first end of hopper car |
| 202—second end of hopper car |
| 210—hopper |
| 220—hopper car wheels |
| 225—hopper car axel |
| 230—hopper gates |
| 260—stacker car |
| 265—generator |
| 270—communication lines |
| 300—self unloading train |

What is claimed is:

1. A self-unloading train, the train comprising:

a plurality of hopper cars, wherein each hopper car includes a hopper having a bottom, a front end, and a rear end, and an individual conveyor belt positioned beneath the bottom of the hopper, adjacent hopper cars of the plurality of hopper cars forming a longitudinally extending transfer region between the front end of the hopper of a rear one of the adjacent hopper cars and the rear end of the hopper of the other of the adjacent hopper cars, the adjacent hopper cars of the plurality of hopper cars having a pivot point located in the transfer region;

wherein each individual conveyor belt includes a tail pulley at a first end and a head pulley at a second end, the tail pulley having a lower height than a height of the head pulley, the first end of the individual conveyor belt extending beyond the rear end of the hopper, the second end of the individual conveyor belt extending toward or to, but not beyond, the pivot point between the adjacent hopper cars, wherein the second end of the individual conveyor belt is adapted to transfer material to the first end of the individual conveyor belt of the adjacent hopper car near the pivot point between the adjacent hopper cars when the train is positioned on a curved section of a railroad track.

2. The train of claim 1, wherein the second end of the individual conveyor belt of one of the plurality of hopper cars is positioned higher than and adjacent a first end of a conveyor belt on a stacker car and the second end of the individual conveyor belts of the rest of the plurality of hopper cars are positioned higher than and adjacent the first end of the individual conveyor belt of an adjacent hopper car of the plurality of hopper cars.

3. The train of claim 2, wherein the individual conveyor belt of at least one of the plurality of hopper cars has a substantially constant inclined slope from the tail pulley to the head pulley.

4. The train of claim 2, wherein each hopper car includes a plurality of gates that open and close an opening in the bottom of the hopper, the opening being positioned above the individual conveyor belt positioned beneath the bottom of the hopper.

5. The train of claim 4, wherein a bottom of the hopper of at least one of the plurality of hopper cars has a slope that is substantially the same as the slope of the individual conveyor belt of the hopper car.

6. The train of claim 4, wherein the opening in the bottom of at least one of the plurality of hopper cars has a slope that is substantially the same as the slope of the individual conveyor belt of the hopper car.

7. The train of claim 2, wherein each hopper car includes a guide positioned above the individual conveyor belt, the guide configured to limit material from falling off of the individual conveyor belt during the transfer of material between hopper cars.

8. The train of claim 1, wherein the second ends of the individual conveyor belts are further adapted to transfer material to the first end of the individual conveyor belt of an adjacent hopper car at the pivot point between the adjacent hopper cars.

9. The train of claim 1, wherein the individual conveyor belt of each hopper car is configured to operate at a rotational speed of at least six feet per second when transferring material to the first end of the individual conveyor belt of the adjacent hopper car when the train is positioned on the curved section of the railroad track.

10. The train of claim 1, wherein the hopper of each hopper car includes side walls extending along a length of the hopper and a plurality of end walls forming the front end and the rear end, the end walls interconnecting the side walls.

11. The train of claim 1, wherein each hopper car includes a first bogie and a second bogie, each of the first bogie and the second bogie having wheels configured to travel along the railroad track, the pivot point being between the first bogie of one of the adjacent hopper cars and the second bogie of the other of the adjacent hopper cars.

12. The train of claim 1, wherein the hopper of each hopper car is configured to hold material in a first area before being dropped onto the individual conveyor belt below the hopper, the individual conveyor belt being outside the first area, wherein the second end of the individual conveyor belt is positioned to transfer material to the first end of the individual conveyor belt of the adjacent hopper car outside the first area of the adjacent hopper car.

13. The train of claim 1, wherein the position of the individual conveyor belt is configured to not engage or contact rigid portions of the adjacent hopper car when transferring material while traveling in or out of the curved section the railroad track.

14. The train of claim 1, wherein the height of the head pulley is always greater than the height of the tail pulley of the adjacent hopper car.

15. A self-unloading train, the train comprising:

a plurality of hopper cars, wherein each hopper car includes a hopper, a first bogie, and a second bogie, the hopper having a bottom and at least one gate to control a flow of material from the hopper, wherein actuation of the gate stops and commences flow of material from the hopper, each of the first bogie and the second bogie having wheels configured to travel along a railroad track, adjacent hopper cars of the plurality of hopper cars having a pivot point between the first bogie of one of the adjacent hopper cars and the second bogie of the other of the adjacent hopper cars; and a plurality of conveyor belts, each one of the plurality of conveyor belts is positioned beneath the bottom of at least one hopper of the plurality of hopper cars, the at least one gate of each hopper car being positioned to drop material from the hopper of the hopper car through the at least one gate onto the conveyor belt positioned beneath the bottom of the hopper;

wherein each conveyor belt of the plurality of conveyor belts includes a tail pulley at a first end and a head pulley at a second end, the head pulley having a higher elevation than an elevation of the tail pulley, the first end of the conveyor belt extending beyond an end of the hopper, the second end of the conveyor belt extending toward or to, but not beyond, the pivot point between the adjacent hopper cars;

wherein the second end of a first conveyor belt of the plurality of conveyor belts is positioned adjacent to the first end of a second conveyor belt of the plurality of conveyor belts so that material will transfer from the first conveyor belt to the second conveyor belt near the pivot point between the adjacent hopper cars when the train is positioned on a curved section of the railroad track.

16. The train of claim 15, wherein the second end of the first conveyor belt is further positioned so that material will transfer from the first conveyor belt to the second conveyor belt at the pivot point between the adjacent hopper cars.

17. The train of claim 15, wherein the hopper of each hopper car is configured to hold material in a first area before being dropped onto the conveyor belt below the hopper, the conveyor belt being outside the first area, wherein the second end of the conveyor belt is positioned to transfer material to the first end of the conveyor belt of the adjacent hopper car outside the first area of the adjacent hopper car.

18. The train of claim 15, wherein the position of each conveyor belt of the plurality of conveyor belts is configured to not engage or contact rigid portions of the adjacent hopper car when transferring material while traveling in or out of the curved section the railroad track.

19. The train of claim 15, wherein the height of the head pulley of the first conveyor belt is always greater than the height of the tail pulley of the second conveyor belt.

20. A self-unloading train, the train comprising:

a plurality of hoppers cars including a first hopper car and a second hopper car, the first hopper car and second hopper each having a hopper with a bottom, a first end, a second end, and at least one gate between the first end and the second end, wherein when connected, the first hopper car and second hopper car form a longitudinally extending transfer region between the first end of the hopper of the first hopper car and the second end of the hopper of the second hopper car, the first hopper car and second hopper car having a pivot point located in the transfer region; and a conveyor belt having a first portion and a second portion, the first portion being positioned beneath the bottom of the hopper at the first end of the hopper, the second portion being positioned beneath the bottom of the hopper at the second end of the hopper, the height of the first portion of the conveyor belt being lower than the height of the second portion of the conveyor belt, the conveyor belt being positioned to receive material from the hopper through the at least one gate;

the conveyor belt of the second hopper car extending toward or to, but not beyond, the pivot point;

wherein when connected, the first hopper car and second hopper car are positioned to transfer material from the conveyor belt of the second hopper car to the conveyor belt of the first hopper car near the pivot point when the train is positioned on a curved section of a railroad track.

21. The train of claim 20, wherein the conveyor belt of the first hopper car extends beyond the first end of the hopper.

22. The train of claim 20, wherein the hopper of the first hopper car includes side walls extending along a length of the hopper and a plurality of end walls forming the first end and the second end, the end walls interconnecting the side walls.

23. The train of claim 20, wherein the hopper of each of the first hopper car and the second hopper car is configured to hold material in a first area before being dropped onto the conveyor belt below the hopper, the conveyor belt being outside the first area, wherein the conveyor belt of the second hopper car is positioned to transfer material to the conveyor belt of the first hopper car of the adjacent hopper car outside the first area of the first hopper car.

24. The train of claim 20, wherein the conveyor belt of the second hopper car is configured to operate at a rotational speed of at least six feet per second when transferring material between the second hopper car and the first hopper car.

25. The train of claim 20, wherein each hopper car includes a first bogie and a second bogie, each of the first bogie and the second bogie having wheels configured to travel along the railroad track, the pivot point being between the first bogie of one of the adjacent hopper cars and the second bogie of the other of the adjacent hopper cars.

26. The train of claim 20, wherein the position of the conveyor belt of the second hopper car is configured to not engage or contact rigid portions of the first hopper car when transferring material while traveling in or out of the curved section the railroad track.

27. The train of claim 20, wherein the height of the second portion of the conveyor belt of the second hopper car is always greater than the height of the first portion of the conveyor belt of the first hopper car.

28. A self-unloading train, the train comprising:

a plurality of hopper cars, wherein each hopper car includes a hopper having a bottom, a first bogie, a second bogie, and an individual conveyor belt positioned beneath the bottom of the hopper, each of the first bogie and the second bogie having wheels configured to travel along a railroad track;

wherein each individual conveyor belt includes a first end and a second end, the first end having a lower height than a height of the second end, the first end extending beyond an end of the hopper, the second end of the individual conveyor belt extending toward or to, but not beyond, a pivot point between the adjacent hopper cars of the individual conveyor belt is adapted to transfer material to the first end of the individual conveyor belt of an adjacent hopper car near the pivot point between the adjacent hopper cars when the train is positioned on a curved section of the railroad track, the pivot point being located between the first bogie of one of the adjacent hopper cars and the second bogie of the other of the adjacent hopper cars, wherein at least one of the individual conveyor belts has a substantially constant inclined slope from the first end to the second end.

29. The self-unloading train of claim 28, wherein the adjacent hopper cars of the plurality of hopper cars form a longitudinally extending transfer region between a front end of the hopper of a rear one of the adjacent hopper cars and a rear end of the hopper of the other of the adjacent hopper cars, the pivot point being-located in the transfer region.

* * * * *